US010180145B2

(12) United States Patent
Chang

(10) Patent No.: US 10,180,145 B2
(45) Date of Patent: Jan. 15, 2019

(54) FAN SALT-FOG-RESISTANT STRUCTURE AND FAN FRAME THEREOF

(71) Applicant: Asia Vital Components Co., Ltd., New Taipei (TW)

(72) Inventor: Bor-Haw Chang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 183 days.

(21) Appl. No.: 14/074,466

(22) Filed: Nov. 7, 2013

(65) Prior Publication Data

US 2015/0125283 A1 May 7, 2015

(51) Int. Cl.
*F04D 29/66* (2006.01)
*F04D 29/52* (2006.01)
*F04D 25/06* (2006.01)

(52) U.S. Cl.
CPC ..... *F04D 29/522* (2013.01); *F04D 25/0613* (2013.01); *F04D 29/667* (2013.01)

(58) Field of Classification Search
CPC ..... F04D 29/40; F04D 29/52; F04D 29/54; F04D 29/541; F04D 29/542; F04D 19/02; F04D 29/403; F04D 29/4226; F04D 29/4253; F04D 29/44; F04D 29/522; F05B 2220/62; F05B 2260/63; F05B 2260/95
USPC ..... 415/211.2, 220, 222, 229
See application file for complete search history.

(56) References Cited

U.S. PATENT DOCUMENTS 4,940,386 A * 7/1990 Feuvrier ..... F01D 9/04 415/189
5,028,216 A * 7/1991 Harmsen ..... F04D 25/0606 417/354
5,944,482 A * 8/1999 Cronin ..... F04D 7/04 415/111
6,170,275 B1 * 1/2001 Ueno ..... F04D 29/541 416/174
7,416,387 B2 * 8/2008 Lan ..... F04D 29/547 415/211.2
7,997,862 B2 * 8/2011 Li ..... F04D 25/0613 415/211.2
8,087,887 B2 * 1/2012 Lee et al. ..... 415/220
(Continued)

FOREIGN PATENT DOCUMENTS

CN 202326409 U 7/2012
CN 203702621 U 7/2014

*Primary Examiner* — Philip Stimpert
(74) *Attorney, Agent, or Firm* — C. G. Mersereau; Nikolai & Mersereau, P.A.

(57) ABSTRACT

A fan salt-fog-resistant structure and a fan frame thereof. The fan salt-fog-resistant structure includes a base seat having a bearing cup and at least one flow guide body. Multiple connection bodies outward extend from the base seat. The flow guide body is disposed at a junction between the base seat and the connection bodies. The fan frame includes a main body having a first open side and a second open side and a flow passage defined therebetween. One end of the connection body is connected with the second open side. When airflow entraining moisture and salt fog flows through the junction between the base seat and the connection bodies, the flow guide body serves to guide the airflow and prevent the airflow from forming eddy, whereby the salt fog entrained by the airflow will not crystallize to form sediments at the junction between the base seat and the connection bodies.

8 Claims, 5 Drawing Sheets

(56) References Cited

U.S. PATENT DOCUMENTS

| | | | | |
|---|---|---|---|---|
| 2008/0093352 | A1* | 4/2008 | Jang | B23K 35/0266 219/145.22 |
| 2009/0142190 | A1* | 6/2009 | Horng | F04D 25/0613 415/200 |
| 2011/0027075 | A1* | 2/2011 | Nogami | F04D 25/0613 415/182.1 |
| 2011/0091315 | A1* | 4/2011 | Chang et al. | 415/182.1 |
| 2014/0003935 | A1* | 1/2014 | Lin | F04D 25/062 415/229 |

* cited by examiner

FAN SALT-FOG-RESISTANT STRUCTURE AND FAN FRAME THEREOF

BACKGROUND OF THE INVENTION

1. Field of the Invention

The present invention relates generally to a fan salt-fog-resistant structure and a fan frame thereof, and more particularly to a fan salt-fog-resistant structure and a fan frame with the fan salt-fog-resistant structure, which can prevent salt fog from crystallizing to form sediments in the fan. Therefore, the lifetime of the fan can be prolonged.

2. Description of the Related Art

The cooling fan has been more and more widely applied to various fields including CPU of an electronic apparatus, server, power supply, communication chassis, communication base station, etc. In some cases, the cooling fan is used in a severe environment such as a moist environment or a salt fog environment. When the fan operates, the airflow will flow through the fan blades and the hub to form an eddy on the bottom of the fan frame. In the case that the fan is positioned in a severe environment, the salt fog may crystallize between the hub and the fan blades. In the case that the fan is not provided with a moisture-proof and salt-fog-resistant structure, the moisture and salt fog will infiltrate into the internal stator assembly and the bearing or even the circuit board to corrode these components. As a result, the lifetime of the fan will be shortened.

A conventional cooling fan generally includes a stator assembly, a rotor assembly, a circuit board, a fan impeller and a fan frame. In order to keep the fan normally operating in the severe environment, it is necessary to provide a moisture-proof and salt-fog-resistant structure for the fan to avoid corrosion of the internal components of the fan. Conventionally, the stator assembly and the circuit board are fully enclosed in a sealant material to prevent the moisture and salt fog from infiltrating into the stator assembly and the circuit board so as to avoid damage of the fan. The sealant can effectively avoid infiltration of the moisture and salt fog. However, the state assembly and the circuit board are totally enclosed in the sealant material so that it is hard to dissipate the heat. As a result, the heat will accumulate to cause rise of temperature.

According to the above, the conventional fan anti-corrosion structure has the following shortcomings:

1. The lifetime of the fan is shortened.
2. The heat is likely to accumulate in the fan to cause rise of temperature.
3. The heat dissipation efficiency is lowered.

SUMMARY OF THE INVENTION

It is therefore a primary object of the present invention to provide a fan salt-fog-resistant structure and a fan frame with the fan salt-fog-resistant structure, which can prevent salt fog from crystallizing to form sediments on the fan frame. By means of the fan salt-fog-resistant structure, the lifetime of the fan is prolonged.

To achieve the above and other objects, the fan salt-fog-resistant structure of the present invention includes a base seat and at least one flow guide body. The base seat has a bearing cup perpendicularly extending from the base seat. Multiple connection bodies outward extend from the base seat. The flow guide body is disposed at a junction between the base seat and the connection bodies. The fan frame includes a main body having a first open side and a second open side and a flow passage defined therebetween. One end of the connection body is connected with the second open side of the main body. When airflow entraining moisture and salt fog flows through the junction between the base seat and the connection bodies, the flow guide body serves to guide the airflow and prevent the airflow from forming eddy, whereby the salt fog entrained by the airflow will not crystallize to form sediments at the junction between the base seat and the connection bodies. Therefore, the lifetime of the fan is prolonged.

In conclusion, the present invention has the following advantages:

1. The lifetime of the fan is prolonged.
2. The flow guide body serves to guide the airflow and prevent the airflow from forming eddy, whereby the salt fog entrained by the airflow will not crystallize to form sediments.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
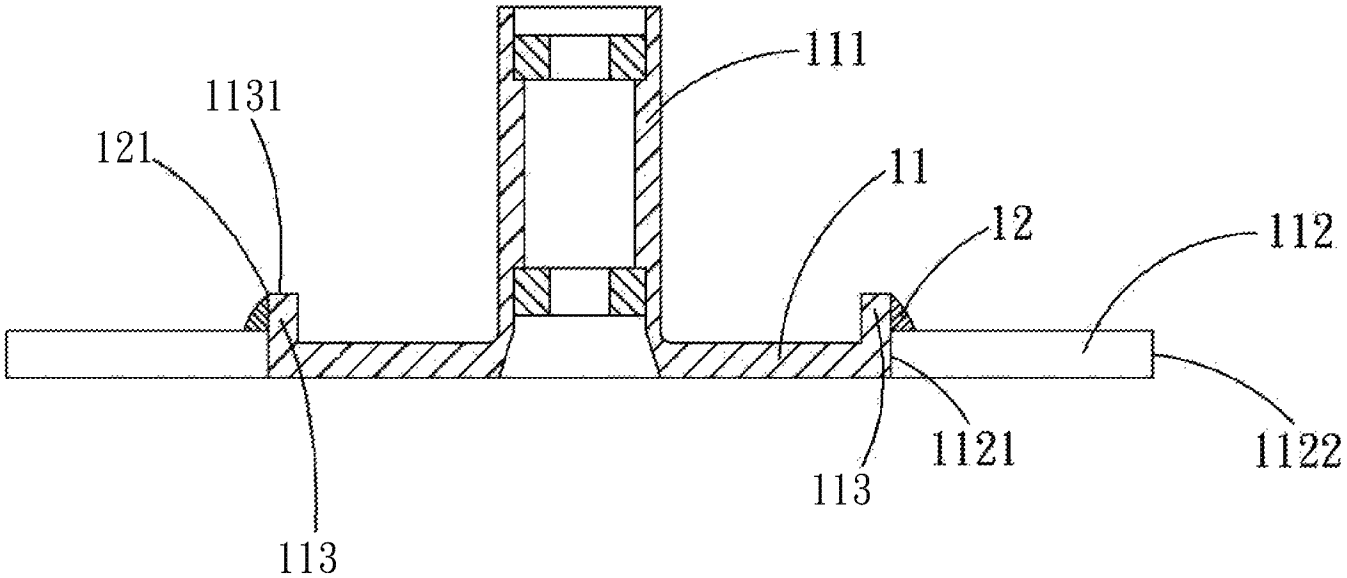
FIG. 1 is a sectional view of a first embodiment of the fan salt-fog-resistant structure of the present invention.

Please refer to FIG. 1, which is a sectional view of a first embodiment of the fan salt-fog-resistant structure of the present invention. According to the first embodiment, the fan salt-fog-resistant structure of the present invention includes a base seat 11 and a flow guide body 12 having a convex arcuate surface.

The base seat 11 has a bearing cup 111 and protrusion extensions 113 perpendicularly extending from one face of the base seat 11 in a direction away from the base seat 11. Multiple connection bodies 112 outward extend from the base seat 11.

The flow guide body 12 comprises a convex arcuate surface is disposed at a junction between the protrusion extension 113 of the base seat 11 and the connection bodies 112. A ridge 121 of the convex arcuate surface of the flow guide body 12 is flush with a top end 1131 of the protrusion extension 113 of the base seat 11.

The connection bodies 112 are fan static blades or ribs. In this embodiment, the connection bodies 112 are, but not limited to, fan static blades for illustration purposes only.

Each connection body 112 has a first connection end 1121 and a second connection end 1122. The first connection end 1121 is connected with the base seat 11. The flow guide body 12 is disposed at the junction between the base seat 11 and the first connection end 1121 on an outer circumference of the base seat 11.

Figure 2:
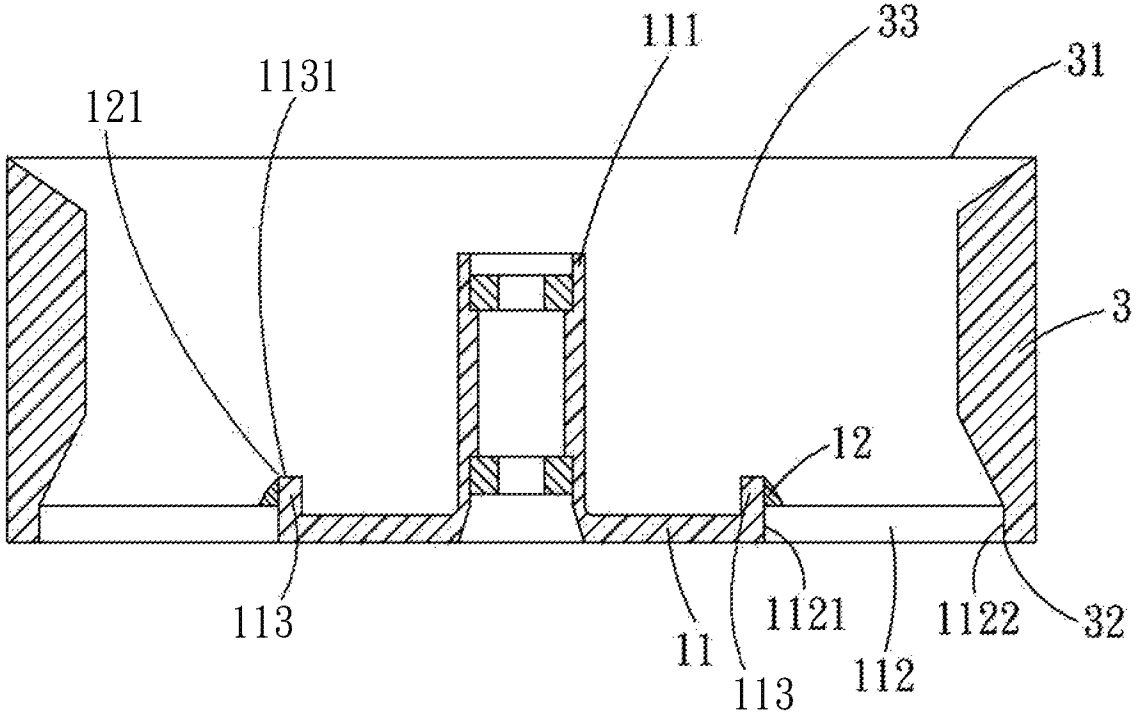
FIG. 2 is a sectional view of a first embodiment of the fan frame with the fan salt-fog-resistant structure of the present invention.

Please now refer to FIG. 2, which is a sectional view of a first embodiment of the fan frame with the fan salt-fog-resistant structure of the present invention. The fan frame includes a main body 3, a base seat 11 and a flow guide body 12.

The main body 3 has a first open side 31 and a second open side 32 and a flow passage 33 defined between the first and second open sides 31, 32.

The base seat 11 has a bearing cup 111 and protrusion extensions 113 perpendicularly extending from one face of the base seat 11. Multiple connection bodies 112 outward extend from the base seat 11. Each connection body 112 has a first connection end 1121 and a second connection end 1122. The first connection end 1121 is connected with the base seat 11. The second connection end 1122 is connected with the second open side 32 of the main body 3. The flow guide body 12 comprises a convex arcuate surface is disposed at the junction between the protrusion extension 113 of the base seat 11 and the connection bodies 112. A ridge 121 of the convex arcuate surface of the flow guide body 12 is flush with a top end 1131 of the protrusion extension 113 of the base seat 11.

Figure 3:
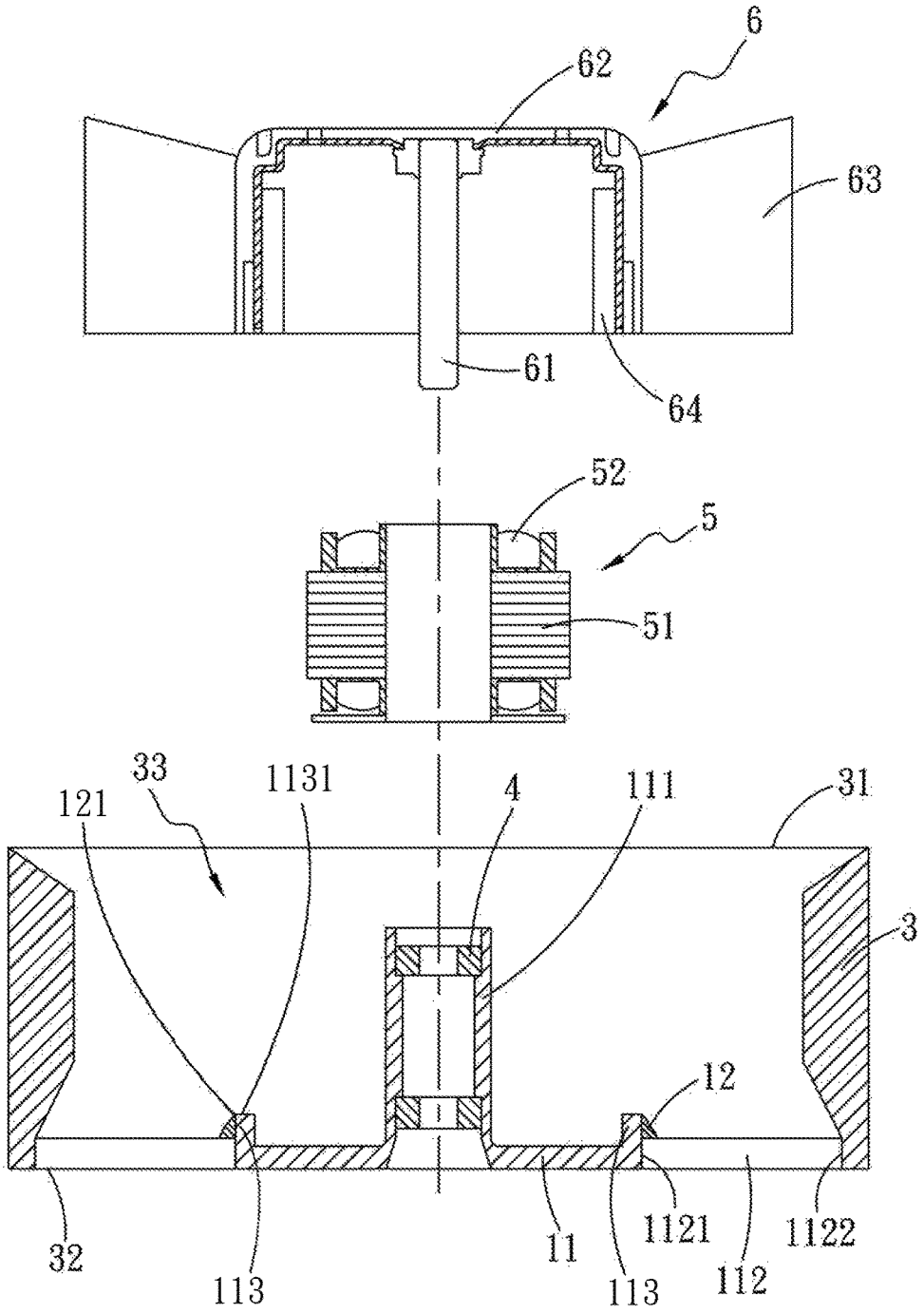
FIG. 3 is a sectional exploded view of a second embodiment of the fan frame with the fan salt-fog-resistant structure of the present invention.
Figure 4:
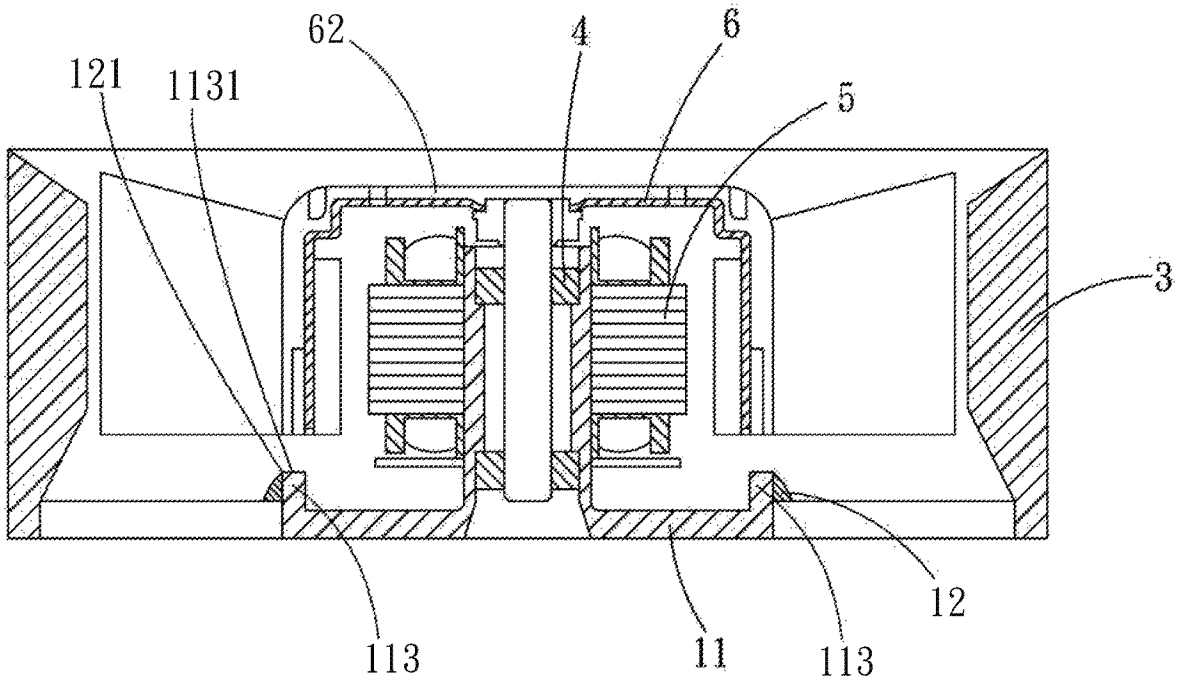
FIG. 4 is a sectional assembled view of the second embodiment of the fan frame with the fan salt-fog-resistant structure of the present invention.

Please now refer to FIGS. 3 and 4. FIG. 3 is a sectional exploded view of a second embodiment of the fan frame with the fan salt-fog-resistant structure of the present invention. FIG. 4 is a sectional assembled view of the second embodiment of the fan frame with the fan salt-fog-resistant structure of the present invention. The second embodiment is partially identical to the first embodiment in component and relationship between the components and thus will not be repeatedly described hereinafter. The second embodiment is mainly different from the first embodiment in that the fan frame further includes at least one bearing 4, a stator assembly 5 and a rotor assembly 6. The bearing 4 is disposed in the bearing cup 111. The stator assembly 5 is fitted around the bearing cup 111. The stator assembly 5 includes multiple silicon steel sheets 51 and multiple windings 52 wound around the silicon steel sheets 51.

The rotor assembly 6 includes a shaft rod 61 and a hub 62. One end of the shaft rod 61 is inserted in the bearing 4 and rotatably connected with the bearing 4. The other end of the shaft rod 61 is connected with the hub 62. The hub 62 has multiple blades 63 disposed on an outer circumference of the hub 62. A magnetic body 64 is annularly arranged on an inner circumference of the huh 62.

Figure 5:
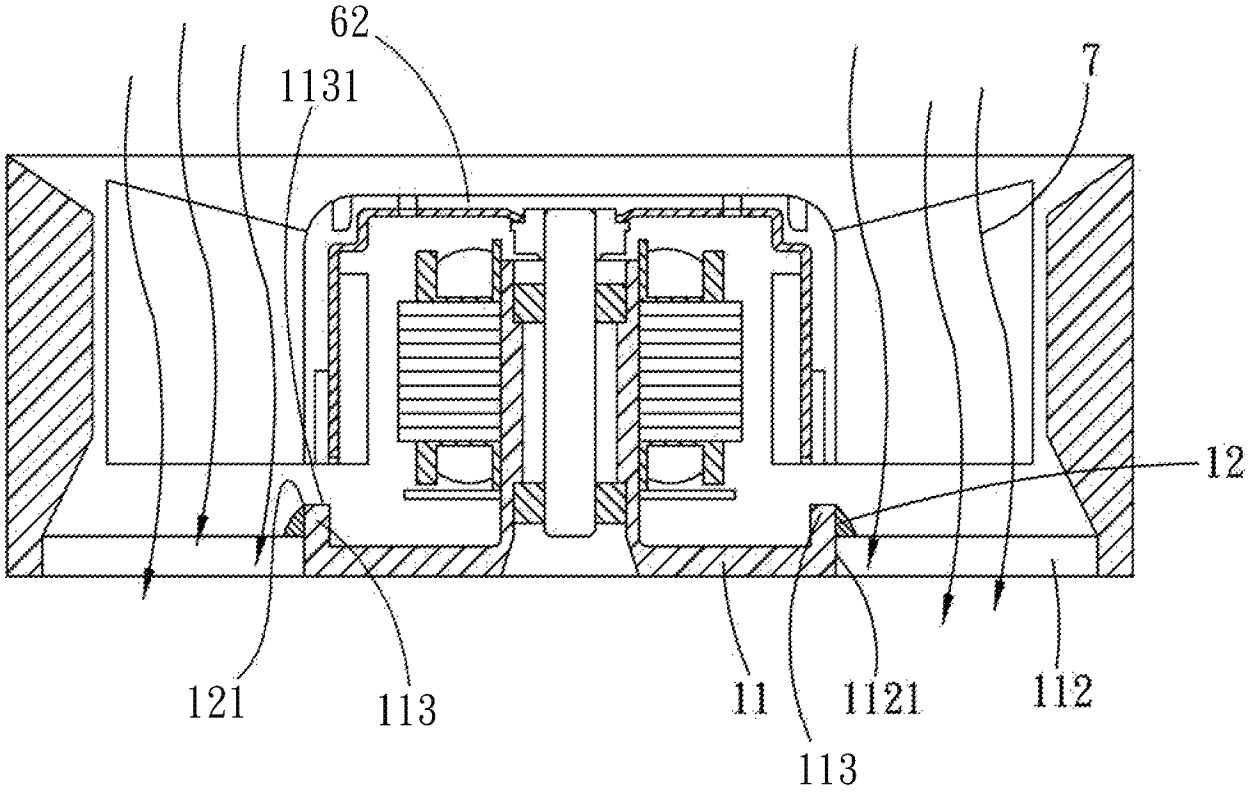
FIG. 5 is a sectional view according to FIG. 4, showing the operation of the present invention.

Please refer to FIG. 5, which is a sectional view according to FIG. 4, showing the operation of the present invention. The flow guide body 12 is disposed at the junction between the base seat 11 and the first connection end 1121 of the connection body 112 on the outer circumference of the base seat 11. Therefore, when airflow 7 entraining moisture and salt fog flows through the junction between the base seat 11 and the first connection end 1121, because the convex arcuate surface of the flow guide body 12 faces into the airflow 7, the flow guide body 12 can serve to guide the airflow 7 and prevent the airflow 7 from forming eddy. In this case, the salt fog will not crystallize to form sediments at the junction between the base seat 11 and the first connection end 1121.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan salt-fog-resistant structure comprising: a base seat having a bearing cup and a protrusion extension perpendicularly extending in an upward direction away from an outer edge of one face of the base seat; and multiple connection bodies extending outward from an outer circumference of the base seat abutting and perpendicular to said protrusion extension, each connection body having a first connection end and a second connection end, each first connection end being connected with the outer circumference of the base seat, each connection body having a flow guide body, each flow wide body being disposed simultaneously at an upper surface of the first connection end of the respective connection body and at the outer circumference of the protrusion extension, each flow guide body comprising a convex arcuate surface and two attaching surfaces respectively disposed at the upper surface of the first connection end of the respective connection body and at the outer circumference of the protrusion extension, each said convex arcuate surface facing into an airflow entraining moisture and the salt fog and being configured to prevent the airflow from forming an eddy, to thereby prevent the moisture and the salt fog from crystallizing to form sediments at the connection between the base seat and the connection bodies; wherein each convex arcuate surface has a cross-sectional contour which bends into the airflow entraining moisture and the salt fog in a plane defined by a longitudinal axis of the bearing cup which is parallel to the upward direction and a longitudinal axis of the respective connection body which extends from the first connection end to the second connection end thereof.

2. The fan salt-fog-resistant structure as claimed in claim 1, wherein the connection bodies are fan static blades.

3. The fan salt-fog-resistant structure as claimed in claim 1, wherein the connection bodies are ribs.

4. A fan frame with a fan salt-fog-resistant structure, comprising: a main body having a first open side and a second open side and a flow passage defined between the first and second open sides; a base seat having a bearing cup and a protrusion extension perpendicularly extending in an upward direction away from an outer edge of one face of the base seat; and multiple connection bodies parallel to and extending outward from an outer circumference of the base seat abutting and perpendicular to said protrusion extension, each connection body having a first connection end and a second connection end, each first connection end being connected with the outer circumference of the base seat, the second connection end of each connection body being connected with the second open side of the main body, each at least one connection body having a flow guide body, each flow guide body being disposed simultaneously at an upper surface of the first connection end of the respective connection body and at the outer circumference of the protrusion extension, each flow guide body comprising a convex arcuate surface and two attaching surfaces respectively disposed at the upper surface of the first connection end of the respective connection body and at the outer circumference of the protrusion extension, each convex arcuate surface facing into an airflow entraining moisture and salt fog and being configured to prevent the airflow from forming an eddy, to thereby prevent the moisture and the salt fog from crystallizing to form sediments at the junction between the base seat and the connection bodies wherein each convex arcuate surface has a cross-sectional contour which bends into the airflow entraining moisture and the salt fog in a plane defined by a longitudinal axis of the bearing cup which is parallel to the upward direction and a longitudinal axis of the respective connection body which extends from the first connection end to the second connection end thereof.

5. The fan frame with the fan salt-fog-resistant structure as claimed in claim 4, wherein the connection bodies are fan static blades.

6. The fan frame with the fan salt-fog-resistant structure as claimed in claim 4, wherein the connection bodies are ribs.

7. The fan frame with the fan salt-fog-resistant structure as claimed in claim 4, further comprising at least one bearing, a stator assembly and a rotor assembly, the bearing being disposed in the bearing cup, the stator assembly being fitted around the bearing cup, the rotor assembly being rotatably connected with the bearing.

8. The fan frame with the fan salt-fog-resistant structure as claimed in claim 7, wherein the stator assembly includes multiple silicon steel sheets and multiple windings wound around the silicon steel sheets, the rotor assembly including a shaft rod and a hub, one end of the shaft rod being inserted in the bearing and rotatably connected with the hearing, the other end of the shaft rod being connected with the hub, the hub having multiple blades disposed on the outer circumference of the hub, a magnetic body being annularly arranged on an inner circumference of the hub.

* * * * *